US006740832B2

(12) United States Patent
Johnston et al.

(10) Patent No.: US 6,740,832 B2
(45) Date of Patent: May 25, 2004

(54) APPARATUS EXHIBITING TACTILE FEEL

(75) Inventors: Raymond P. Johnston, Lake Elmo, MN (US); Brian E. Spiewak, Inver Grove Heights, MN (US); Jennifer R. Yi, Roseville, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 118 days.

(21) Appl. No.: 10/108,112

(22) Filed: Mar. 27, 2002

(65) Prior Publication Data

US 2003/0183497 A1 Oct. 2, 2003

(51) Int. Cl.[7] ..... H01H 1/00; H01H 13/702

(52) U.S. Cl. ..... 200/512; 200/1 R; 200/5 A; 200/237

(58) Field of Search ..... 200/1 R, 5 R, 200/5 A, 512–517, 61, 43, 86 R, 275, 1 B, 318–327

(56) References Cited

U.S. PATENT DOCUMENTS

| | | | | |
|---|---|---|---|---|
| 2,877,439 A | * | 3/1959 | Avery | 200/275 |
| 3,266,113 A | | 8/1966 | Flanagan, Jr. | |
| 3,699,296 A | | 10/1972 | Harris | |
| 3,718,791 A | * | 2/1973 | Szablowdkil | 200/85 A |
| 3,879,835 A | | 4/1975 | Brumlik | |
| 4,109,118 A | | 8/1978 | Kley | |
| 4,200,777 A | * | 4/1980 | Miller | 200/85 A |
| 4,249,044 A | | 2/1981 | Larson | |
| 4,290,832 A | | 9/1981 | Kalleberg | |
| 4,349,710 A | * | 9/1982 | Miller | 200/61.43 |
| 4,421,958 A | | 12/1983 | Kameda | |
| 4,500,758 A | | 2/1985 | Guckenheimer | |
| 4,508,942 A | | 4/1985 | Inaba | |
| 4,528,431 A | | 7/1985 | Coleman, III | |
| 4,859,820 A | | 8/1989 | Gotfryd | |
| 4,862,499 A | | 8/1989 | Jekot et al. | |
| 4,864,085 A | | 9/1989 | Hanajima et al. | |
| 4,894,060 A | | 1/1990 | Nestegard | |
| 5,119,531 A | | 6/1992 | Berger et al. | |
| 5,235,731 A | | 8/1993 | Anzai et al. | |
| 5,396,687 A | | 3/1995 | Osterman | |

(List continued on next page.)

FOREIGN PATENT DOCUMENTS

| | | |
|---|---|---|
| DE | 32 18 404 A1 | 11/1983 |
| DE | 198 19 693 A1 | 11/1999 |
| DE | 200 02 680 U1 | 6/2000 |
| DE | 200 09 377 U1 | 9/2000 |
| DE | 200 09 919 U1 | 9/2000 |
| DE | 200 16 887 U1 | 2/2001 |
| EP | 0 942 444 A2 | 9/1999 |
| EP | 1 001 443 A1 | 5/2000 |
| EP | 1 024 510 A2 | 8/2000 |
| EP | 1 056 107 A2 | 11/2000 |
| WO | WO 98/39785 | 9/1998 |
| WO | WO 01/58302 | 8/2001 |
| WO | WO 01/58780 | 8/2001 |

OTHER PUBLICATIONS

IBM Technical Disclosure Bulletin, "Key Matrix Using a Flulid Medium," p. 744, Aug. 1970.
English Language Abstract.
English Language Abstract.

*Primary Examiner*—James R. Scott
(74) *Attorney, Agent, or Firm*—Stephen W. Buckingham

(57) ABSTRACT

A switch apparatus includes a first layer and a second layer attached to one another via sets of fastening elements formed on the layers. The fastening elements may comprise hook-like elements that engage one another in an interlocking arrangement to attach the layers, or alternatively, the fastening elements may take other forms. The fastening elements may include flexible portions that flex when the first layer and second layer are forced together. The apparatus may be used within switch arrays, and can eliminate the need for dome spring elements.

29 Claims, 14 Drawing Sheets

U.S. PATENT DOCUMENTS

| | | | |
|---|---|---|---|
| 5,398,387 | A | 3/1995 | Torigoe et al. |
| 5,457,297 | A | 10/1995 | Chen |
| 5,505,747 | A | 4/1996 | Chesley et al. |
| 5,514,843 | A | 5/1996 | Wilfong et al. |
| 5,630,501 | A | 5/1997 | Tsay |
| 5,666,112 | A | 9/1997 | Crowley et al. |
| 5,742,242 | A | 4/1998 | Sellers |
| 5,760,351 | A | 6/1998 | Tsai |
| 5,812,116 | A | 9/1998 | Malhi |
| 5,856,641 | A | 1/1999 | Schreiber et al. |
| 5,874,700 | A | 2/1999 | Hochgesang |
| 5,879,088 | A | 3/1999 | English |
| 5,888,621 | A | 3/1999 | Frohlich et al. |
| 5,967,298 | A | 10/1999 | Watanabe et al. |
| 6,064,019 | A | 5/2000 | Buchan et al. |
| 6,100,478 | A | 8/2000 | LaPointe et al. |
| 6,130,593 | A | 10/2000 | Van Zeeland |
| 6,137,072 | A | 10/2000 | Martter et al. |
| 6,144,003 | A | 11/2000 | Kamishima |
| 6,178,619 | B1 | 1/2001 | Tai |

* cited by examiner

APPARATUS EXHIBITING TACTILE FEEL

FIELD

The invention relates to switch arrays for use in computer input devices, and more particularly, to structures within switch arrays.

BACKGROUND

Electronic switches are used to provide input to computer devices. Electronic switches generate signals in response to physical force. For example, a user may actuate an electronic switch by pressing a key. Pressing the key causes a force to be applied on an electronic membrane, which in turn causes the electronic membrane to generate an electronic signal. Computer keyboards, keypads, and membrane switches are common examples of switch arrays.

Many switch arrays, such as keyboards, include dome spring elements to provide a biasing force against individual keys. Dome spring elements provide tactile feedback to a user by providing a defined amount of resistance to key actuation. Moreover, dome spring elements provide a "snapping" feel upon actuation, wherein the amount of resistance to key actuation drastically decreases after pressing the key beyond a threshold distance.

SUMMARY

In general, the invention provides an apparatus for use in switch arrays. The apparatus incorporates a tactile feel similar to that typically associated with dome spring elements, without using dome springs. In one embodiment, the invention is directed toward an apparatus that includes a first layer and a second layer attached with one another via sets of fastening elements formed on the layers. The fastening elements may comprise hook-like elements that engage one another in an interlocking arrangement to attach the layers, or alternatively, the fastening elements may take other forms envisioned by a designer. The fastening elements may include flexible portions that flex when the first layer and second layer are forced together. The apparatus may be used within switch arrays, eliminating the need for dome spring elements.

Additional details of these and other embodiments are set forth in the accompanying drawings and the description below. Other features, objects and advantages will become apparent from the description and drawings, and from the claims.

DETAILED DESCRIPTION

In general, the invention is directed toward an apparatus that includes a first layer and a second layer attached to one another via sets of fastening elements formed on the layers. For example, the fastening elements may comprise hook-like elements that engage one another in an interlocking arrangement to attach the layers. Alternatively, the fastening elements may take other forms envisioned by a designer. In any case, at least some of the fastening elements are able to flex when the first layer and second layer are forced together. In this manner, a desirable tactile feel can be achieved when the apparatus is implemented within a switch array.

Figure 1A:
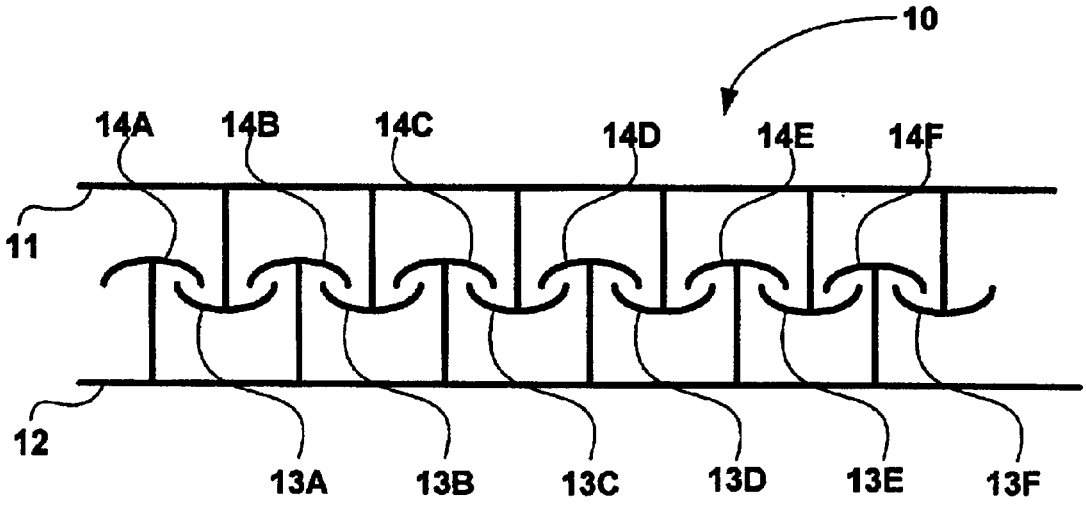
FIGS. 1A and 1B are a cross-sectional side views of an apparatus according to an embodiment of the invention.
Figure 1B:
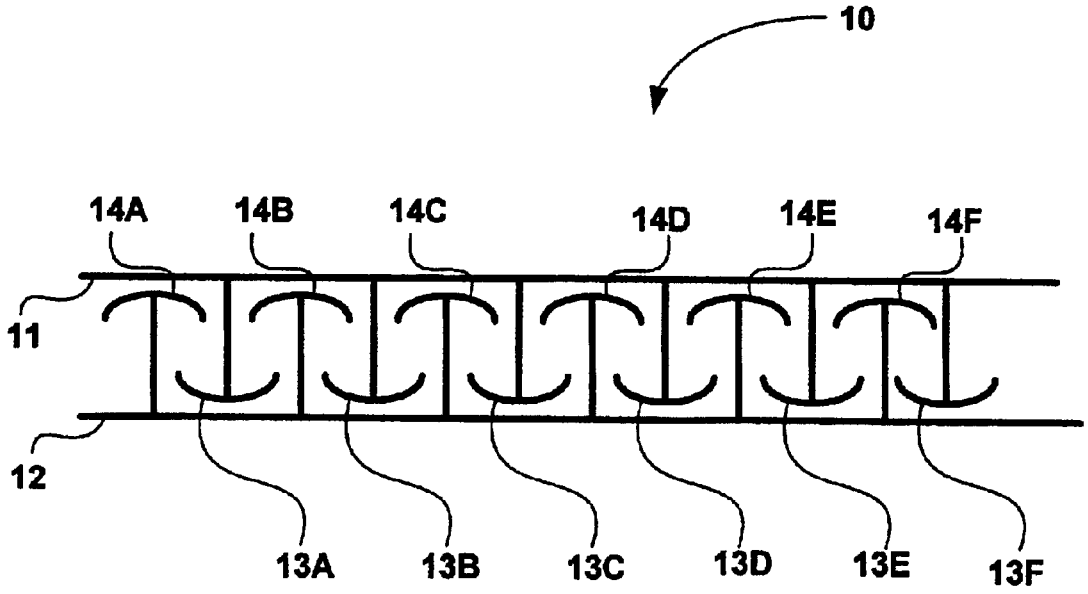

FIGS. 1A and 1B are cross-sectional side views of apparatus 10 according to an embodiment of the invention. As shown, apparatus 10 includes a top layer 11 and a bottom layer 12. Top layer 11 includes a set of fastening elements 13A–13F (hereafter fastening elements 13), and a bottom layer 12 includes another set of fastening elements 14A–14F (hereafter fastening elements 14). At least a portion of at least some of fastening elements 13, 14 are flexible.

Figure 2:
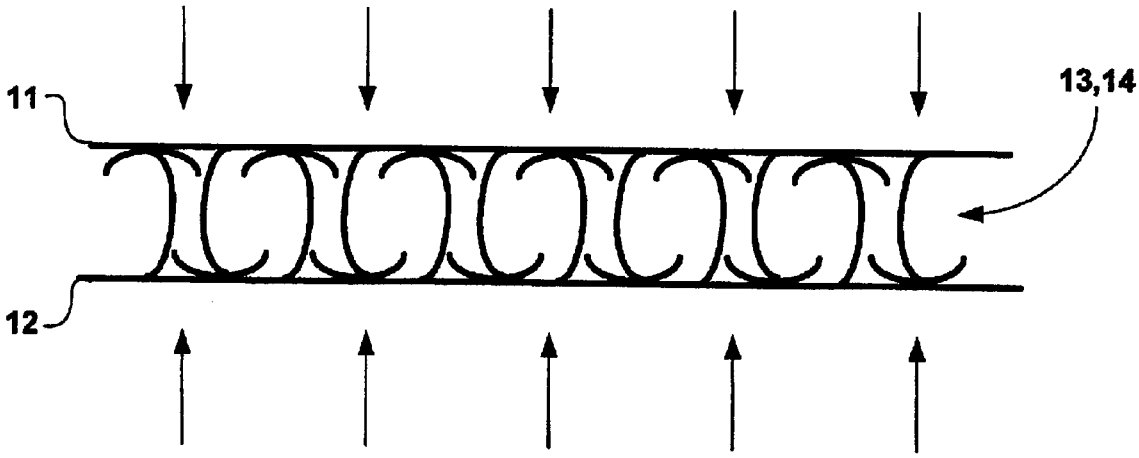
FIG. 2 is a cross-sectional side view of the apparatus in FIGS. 1A and 1B, with the top and bottom layers being forced together.

For example, as shown in FIG. 2, when a force is applied to force top layer and bottom layer 12 together (as indicated by the arrows), the fastening elements 13, 14 can flex. This flexing provides a biasing force that tends to push top layer 11 and bottom layer 12 apart. As outlined in greater detail below, this biasing force can be made to substantially decrease when the distance between the first and second layers passes a threshold. For example, one or more of fastening elements 13, 14 may buckle after the distance between the first and second layers passes a threshold. Apparatus 10 may be useful for a number of applications, including switch arrays. In that case, apparatus 10 can be used to form keys of the switch array, and can provide a desired tactile feel without implementing dome spring elements.

Figure 3:
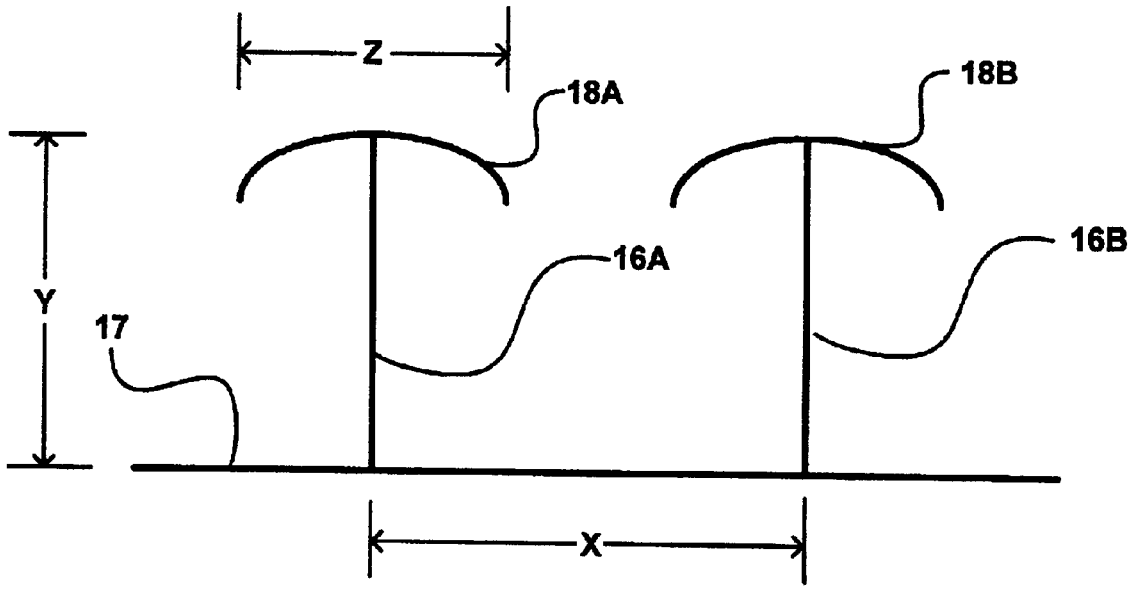
FIG. 3 is a cross-sectional side view of two exemplary fastening elements.

FIG. 3 is a cross-sectional side view of two fastening elements. Again, although illustrated as having a hook-like shape, the fastening elements may take other forms. Some other examples are described below. If the fastening elements have a hook-like shape, they may include a stem 16A, 16B that attaches hook 18A, 18B to base 17. Distance (X) between stems 18A and 18B may be on the order of 0.25 centimeters although the invention is not necessarily limited in that respect. The height (Y) of fastening elements may be in the range of 0.01 centimeters to 1 centimeter although the invention is not necessarily limited in that respect. The fastening element width (Z) may be in the range of 0.01 centimeters to 1 centimeter although the invention is not necessarily limited in that respect. These shapes and sizes are exemplary for applications in switch arrays. However, the shapes and sizes may differ from the exemplary ranges listed above.

The distance of travel allowed prior to flexing of the fastening elements of the engaged layers (as illustrated in FIGS. 1A and 1B) may be in the range of 0.01 centimeters to 1 centimeter. For example, a distance of travel of less than 3 millimeters, less than 2 millimeters, or even less than 1 millimeter may be desirable for various applications, including applications in switch arrays such as keyboards, keypads or membrane switches. In any case, the amount of travel can be designed according to particular design specifications to achieve a desired tactile effect. In some cases, it may be desirable to allow little or no travel prior to flexing of the fastening elements.

If the fastening elements have a hook-like shape as illustrated in FIG. 3, stem 16 can be made flexible. Moreover, the biasing force associated with the flexing of stem 16 may substantially decrease after stem 16 flexes beyond a threshold. For example, stem 16 may buckle after flexing beyond the threshold. In this manner, a tactile feel similar to that associated with dome spring elements can be incorporated within fastening structure 10.

Figure 4:
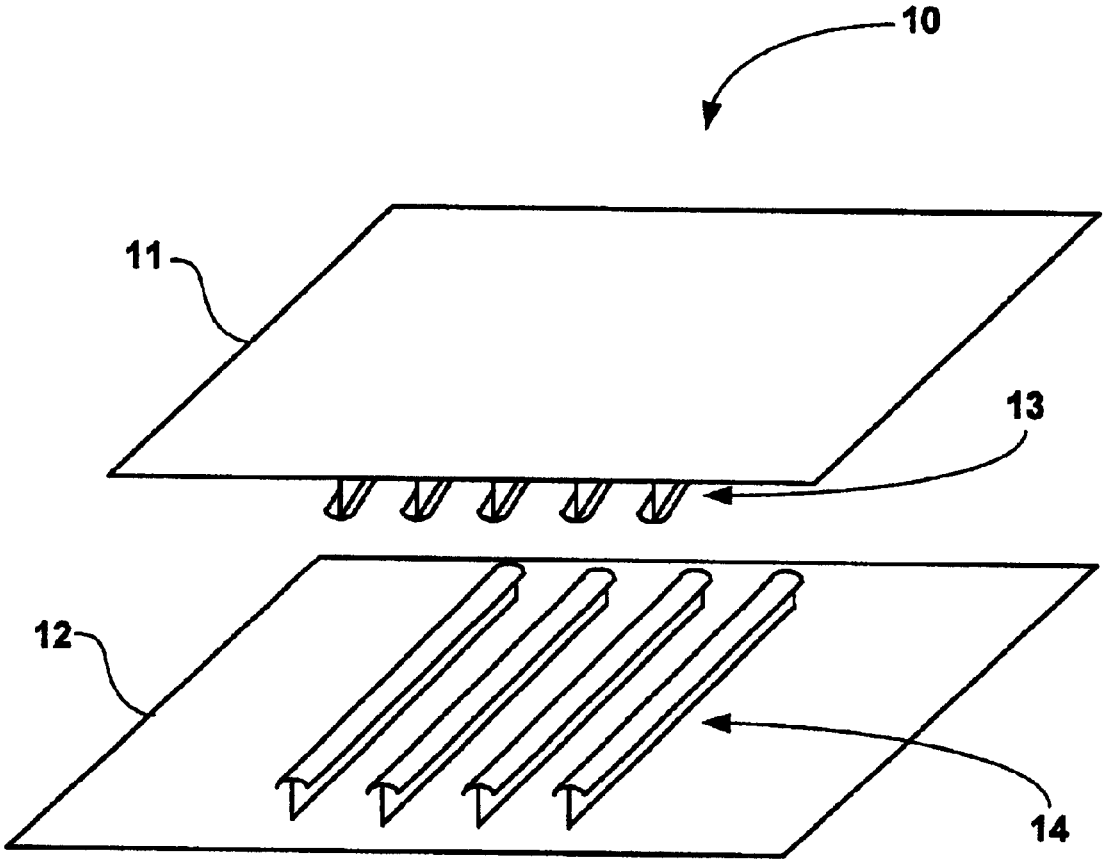
FIG. 4. is a perspective view of an apparatus according to the invention in an unengaged state.

FIG. 4 is a perspective view of fastening structure 10 in an unengaged state. For example, each of the top and bottom layers 11, 12 may comprise films of material extruded according to the desired shape of fastening elements 13, 14. More specifically, a co-extrusion process may be used, in which one or more of the stems of fastening elements 13, 14 comprise a flexible material such as sufficiently flexible polymer. The base of layers 11, 12 and the hooks of fastening elements 13, 14 may be substantially rigid, allowing top layer 11 and bottom layer 12 to be securely fastened to one another. For example, a substantially rigid polymer may be used for the base and hooks of layers 11, 12. Additionally, in some cases, the size of fastening elements 13, 14 may be different for different layers 11, 12, or may even have different sizes on a given layer 11, 12 as outlined in greater detail below.

If desired, the fastening structure 10, may further include elastic balls, posts, or the like positioned between the layers 11, 12 to provide additional biasing force that tends to bias the top layer 11 and bottom layer 12 in an open position (as illustrated in FIG. 1A). The layers 11, 12 may be engaged by snapping or sliding them together. For example, hook-like fastening elements on the top and bottom layers 11, 12 may snap together such that they are engaged in an interlocking arrangement as illustrated in FIGS. 1A and 1B. A predetermined distance of travel allowed between the top and bottom layers 11, 12 may be proportional to the size of one or more of the fastening elements 13, 14.

Figure 5A:
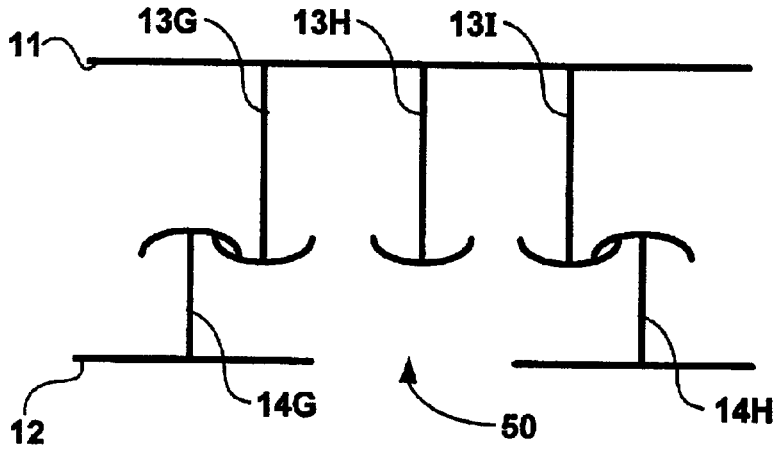
FIGS. 5A–5C are cross-sectional side views illustrating the flexing of fastening elements of an apparatus according to an embodiment of the invention.
Figure 5B:
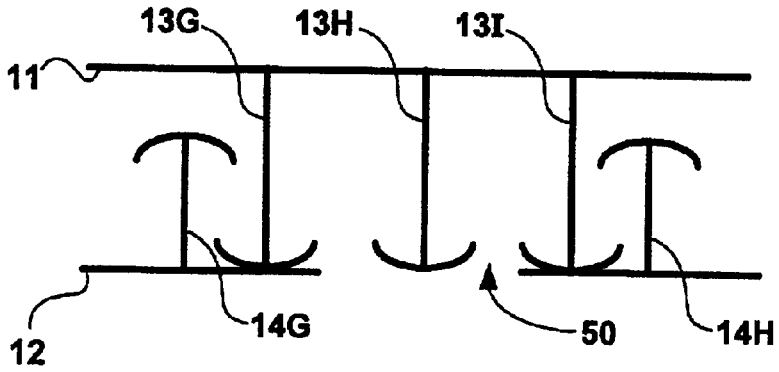
Figure 5C:
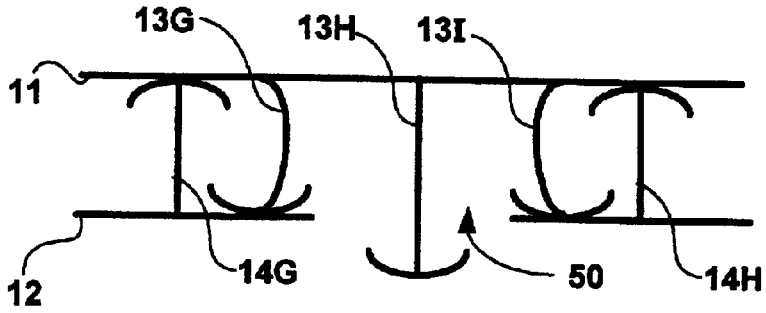

FIGS. 5A–5C are cross-sectional side views illustrating the flexing of fastening elements of an apparatus according to an embodiment of the invention. As shown, top layer 11 is engaged with bottom layer 12. Bottom layer 12 is formed with hole 50. For example, hole 50 can be aligned with a sensor element of a switch array so that when top layer 11 is forced toward bottom layer 12, the sensor can be actuated. For example, one of the fastening elements 13 may protrude through hole 50 when top layer 11 is pressed against bottom layer 12 as illustrated in FIG. 5C.

In this example, the stem portion of elements 13G–13I are longer than the stem portion of elements 14G and 14H. When the top layer 11 is forced against the bottom layer 12, the hook portion of elements 13G and 13I contact the base portion of bottom layer 12 as illustrated in FIG. 5B. When additional force is applied, the stem portions of elements 13G and 13I may flex as illustrated in FIG. 5C. The flexing of elements 13G and 13I can cause element 13H to protrude through hole 50 so that a sensor can be actuated. The sensor or sensors may comprise any of a wide variety of sensors used in keyboards or other switch arrays. For example, the techniques and structures described herein may be used with electrical sensors such as hall effect sensors, piezo electric sensors, piezo resistive sensors, electrostatic sensors, micro electrical mechanical systems (MEMS) sensors, or the like. In addition, pressure sensors, chemical sensors, or any other sensors may also be used.

Figure 6A:
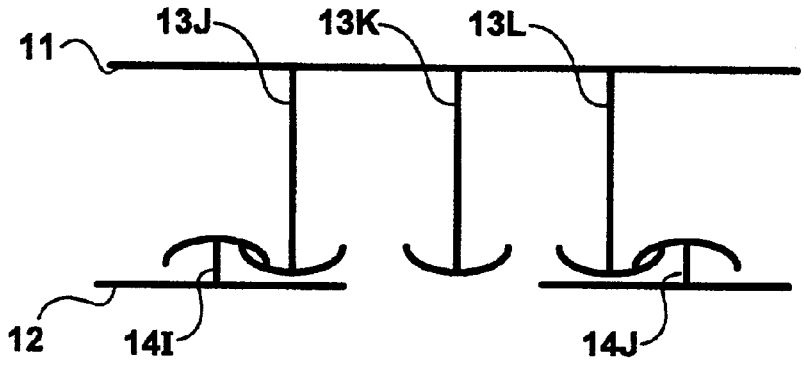
FIGS. 6A–6C are additional cross-sectional side views illustrating the flexing of fastening elements of an apparatus according to an embodiment of the invention.
Figure 6B:
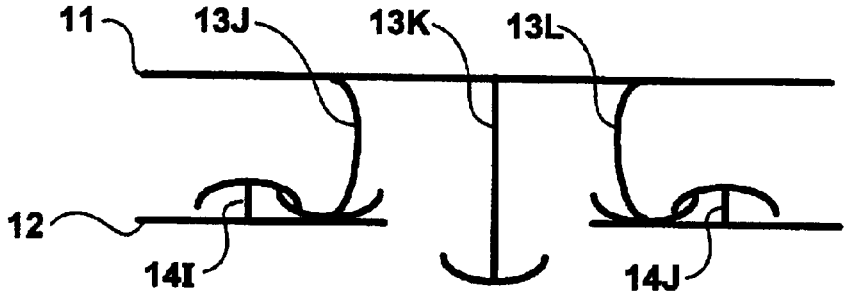
Figure 6C:
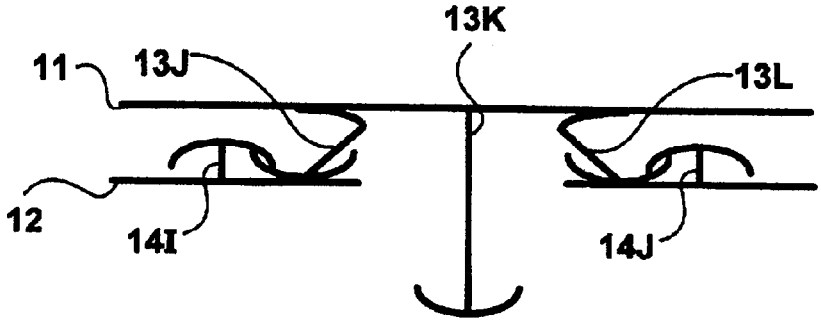

FIGS. 6A–6C are additional cross-sectional side views illustrating the flexing of fastening elements of an apparatus according to an embodiment of the invention. In this example, elements 14I and 14J of bottom layer 12 are sufficiently short so as to limit the amount of travel between top layer 11 and bottom layer 12 that can occur without flexing the elements 13J and 13L of top layer 11. When top layer 11 is forced against the bottom layer 12, the stem portions of elements 13J and 13L may flex as illustrated in FIG. 6B. This flexing provides a biasing force that tends to force top layer 11 and bottom layer 12 apart. An alternative configuration, in which the elements of top layer 11 are sufficiently short and the elements of bottom layer 12 are longer and have flexible stems could also be used.

The biasing force that tends to force top layer 11 and bottom layer 12 apart can be made to substantially decrease when the distance between the first and second layers passes a threshold. For example, as illustrated in FIG. 6C, fastening elements 13J and 13L may buckle when the distance between the first and second layers passes a threshold. When this occurs, the biasing force between top layer 11 and bottom layer 12 substantially decreases. In this manner, the tactile feel typically associated with dome spring elements can be achieved without implementing dome spring elements.

For example, top layer 11 as illustrated in FIGS. 6A–6C may correspond to a key of a switch array. When a user presses the key, resistance is felt when elements 13J and 13L flex as illustrated in FIG. 6B. Then, the resistance substantially decreases as the key snaps downward as illustrated in FIG. 6C. For example, elements 13J and 13L may buckle, which causes the resistance to substantially decrease. At that point, element 13K may protrude through a hole in bottom layer 12, for example, to actuate a sensor. When the user releases the key, apparatus 10 may reassume the configuration of FIG. 6A. In this manner, apparatus 10 can be used to realize a key of a switch array that exhibits a desirable tactile feel without using dome springs.

Figure 7A:
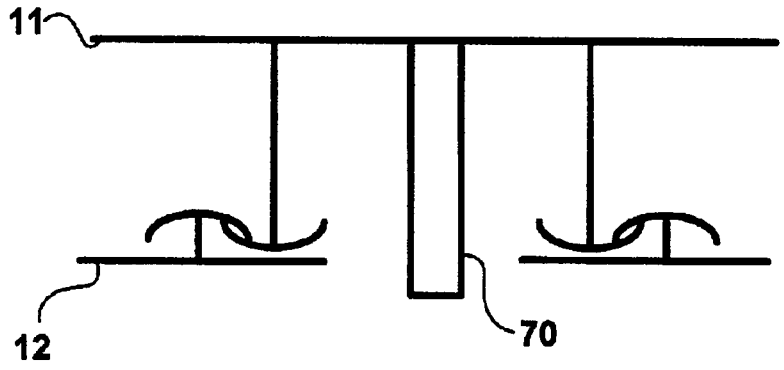
FIGS. 7A–7C are additional cross-sectional side views illustrating the flexing of fastening elements of an apparatus according to an embodiment of the invention.
Figure 7B:
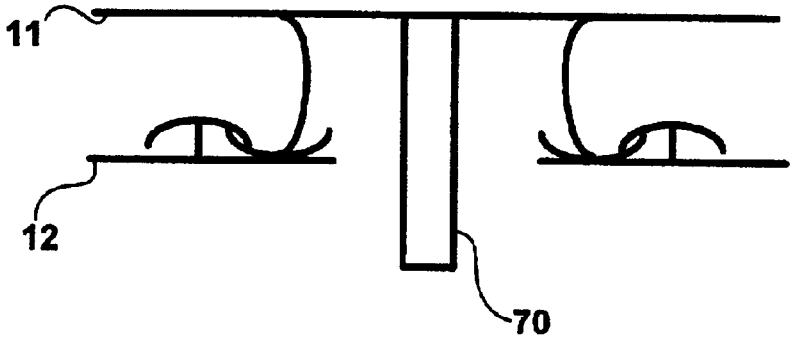
Figure 7C:
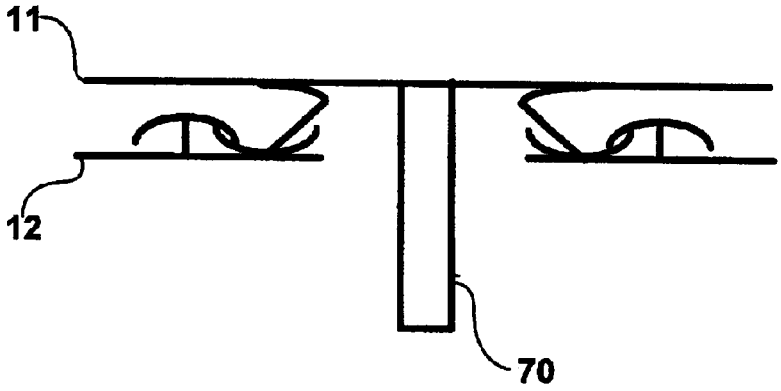

FIGS. 7A–7C are additional cross-sectional side views illustrating the flexing of fastening elements of an apparatus according to an embodiment of the invention. In this case, top layer 11 may include a substantially rigid structure 70 that protrudes through hole 50 of bottom layer 12 when the top layer is forced against the bottom layer 12. Rigid structure 70 may be implemented to facilitate actuation of a sensor element associated with the switch array.

Figure 8A:
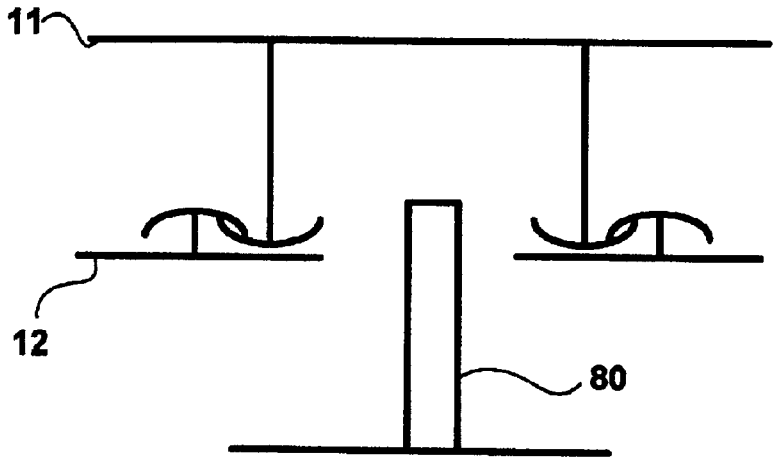
FIGS. 8A–8C are additional cross-sectional side views illustrating the flexing of fastening elements of an apparatus according to an embodiment of the invention.
Figure 8B:
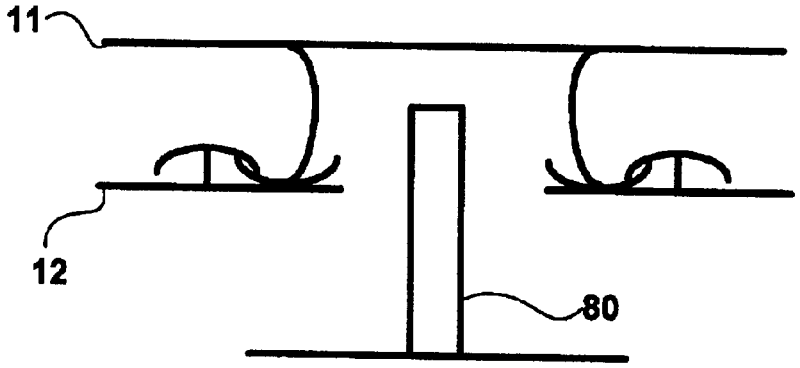
Figure 8C:
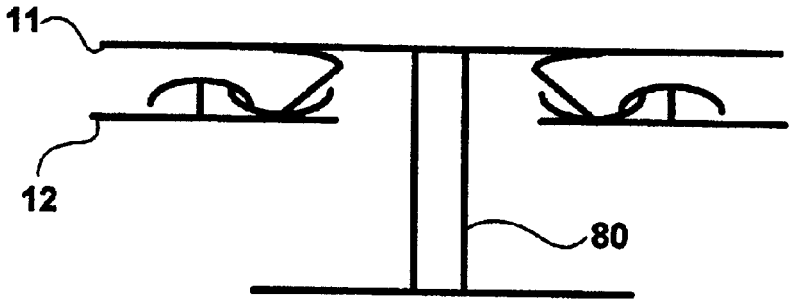

In FIGS. 8A–8C, structure 80 does not form part of apparatus 10. Instead, structure 80 protrudes through hole 50 such that when top layer 11 is forced against bottom layer 12, top layer 11 makes physical contact with structure 80 as illustrated in FIG. 8C. The physical contact between structure 80 and top layer 11 may cause actuation of a sensor within a switch array.

Figure 9A:
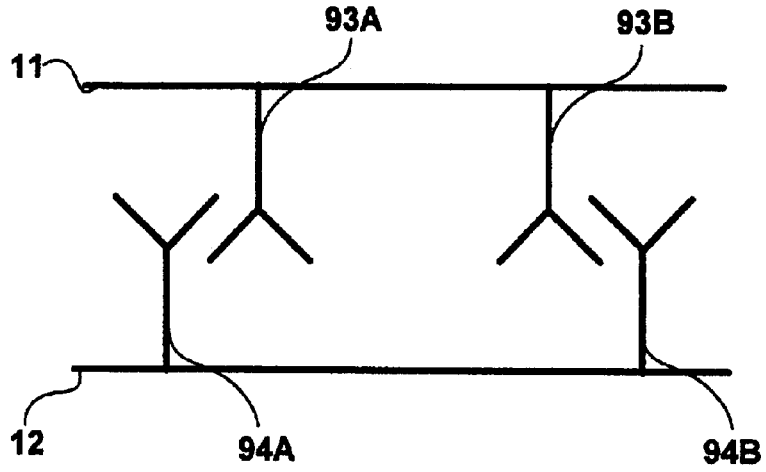
FIGS. 9A–9C are cross-sectional side views of another embodiment illustrating the flexing of fastening elements of an apparatus according to an embodiment of the invention.
Figure 9B:
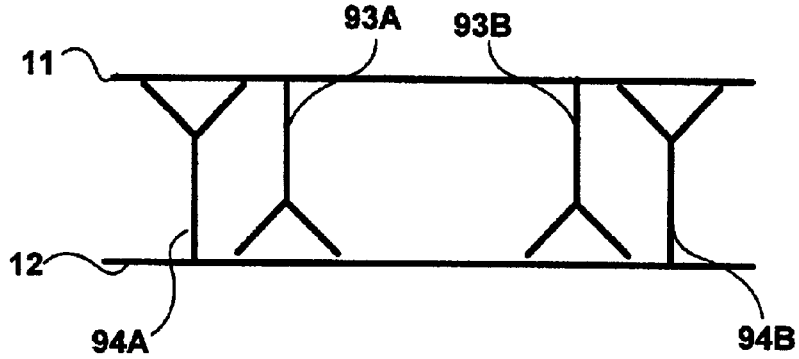
Figure 9C:
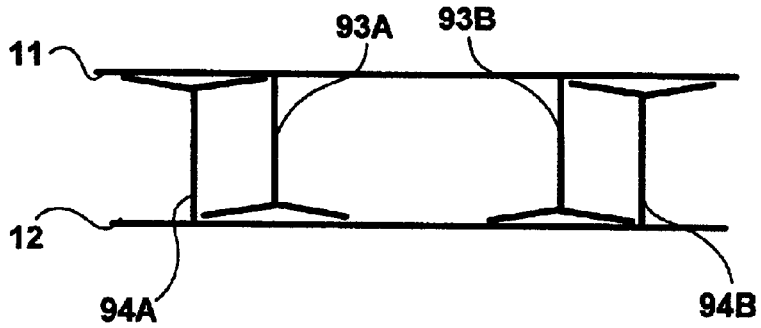

FIGS. 9A–9C are cross-sectional side views of another embodiment illustrating the flexing of fastening elements of an apparatus according to an embodiment of the invention. In this case, elements 93A, 93B, 94A and 94B of top and bottom layers 11, 12 comprise Y-shaped elements that engage one another. The tips of the Y-shaped elements may flex as illustrated in FIG. 9C when the top layer 11 and bottom layer 12 are forced together. Again, this flexing may provide a biasing force that tends to force top layer 11 and bottom layer 12 apart. For switch arrays, the flexing of Y-shaped elements can be used to achieve a desired resistance and desired feel to key actuation.

Figure 10A:
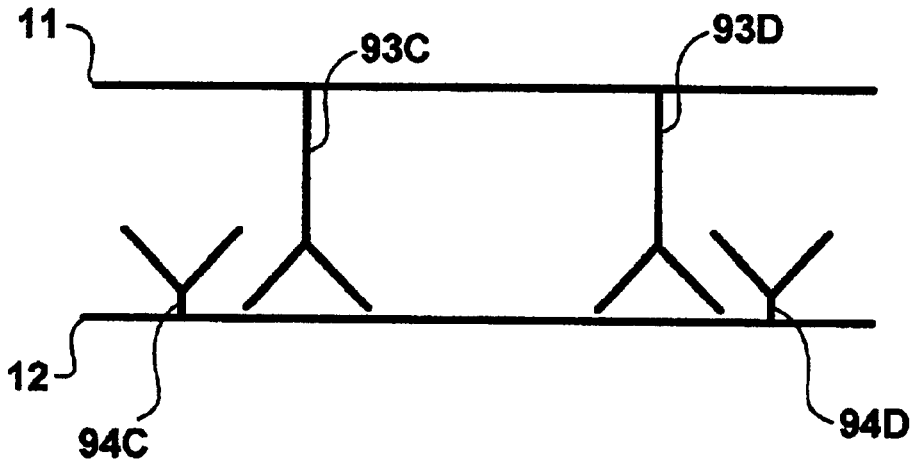
FIGS. 10A–10B are cross-sectional side views of another embodiment illustrating the flexing of fastening elements of an apparatus according to an embodiment of the invention.
Figure 10B:
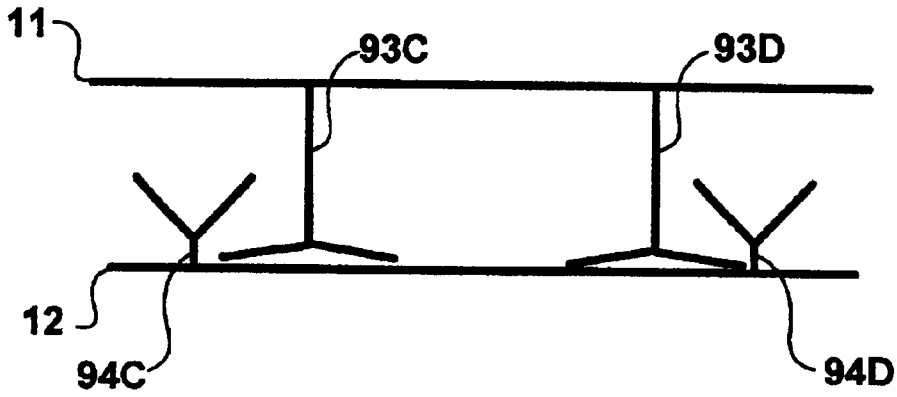

FIGS. 10A–10B illustrate an embodiment similar to that of FIGS. 9A–9C. In FIGS. 10A–10B, however the stems associated with the elements 94C and 94D of bottom layer 12 are much shorter than those associated with the elements 93C and 93D of top layer 11. Alternatively, the elements of top layer can be made much shorter than those of bottom layer. In either case, the amount of travel between top layer 11 and bottom layer 12 that can occur without the elements 93 of top layer 11 flexing can be limited. Such a configuration may be desirable for keys of switch arrays. One or more stem portions of elements 93C, 93D, 94C or 94D may also be flexible. In that case, the stems may buckle when enough force is applied to provide a tactile feel conventionally associated with dome spring elements.

Figure 11A:
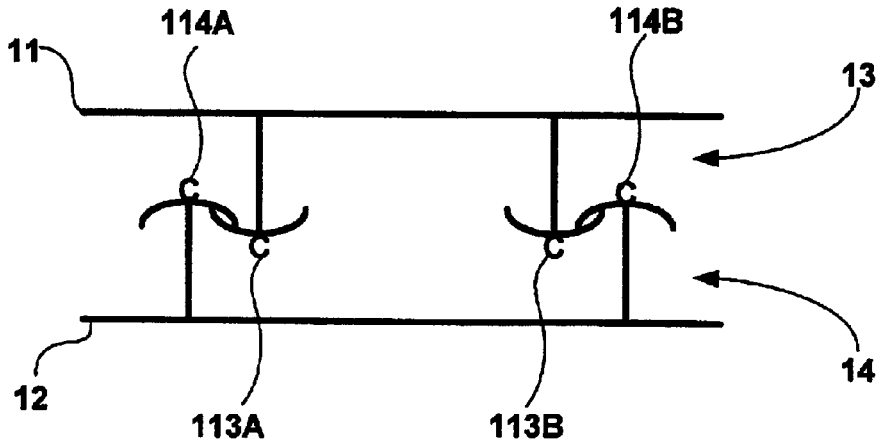
FIGS. 11A–11C are cross-sectional side views of another embodiment illustrating the flexing of fastening elements of an apparatus according to an embodiment of the invention.
Figure 11B:
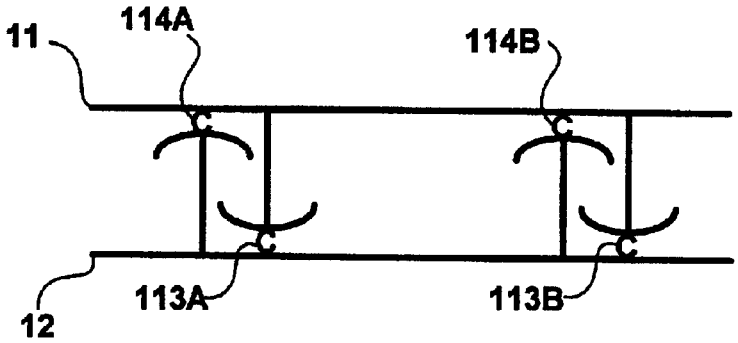
Figure 11C:
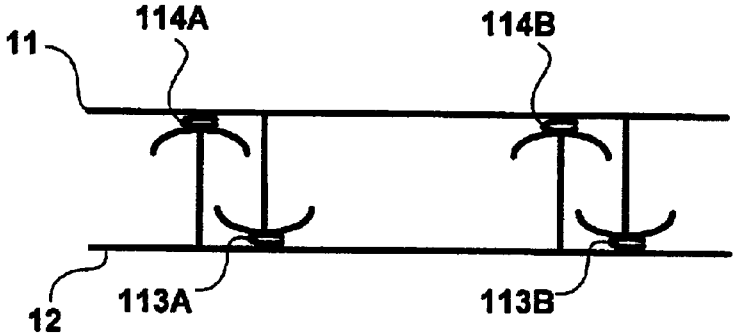

FIGS. 11A–11C are cross-sectional side views of another embodiment illustrating the flexing of fastening elements of an apparatus according to an embodiment of the invention. In this case, one or more of elements 13, 14 include flexible extensions 113A, 113B, 114A and 114B. In this example, the flexible extensions comprise C-shaped extensions. However, other shapes could be used. As shown in FIG. 11C, when the top and bottom layers 11, 12 are forced together, the extensions 113, 114 flex. In this manner, a desired resistance and feel associated with key actuation can be achieved. Again, one or more stem portions of elements 13, 14 may also be flexible to provide the snapping effect.

Figure 12A:
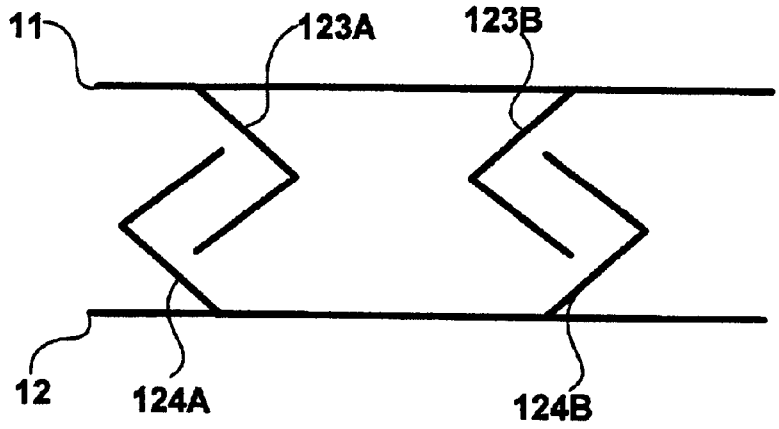
FIGS. 12A–12C are cross-sectional side views of another embodiment illustrating the flexing of fastening elements of an apparatus according to an embodiment of the invention.
Figure 12B:
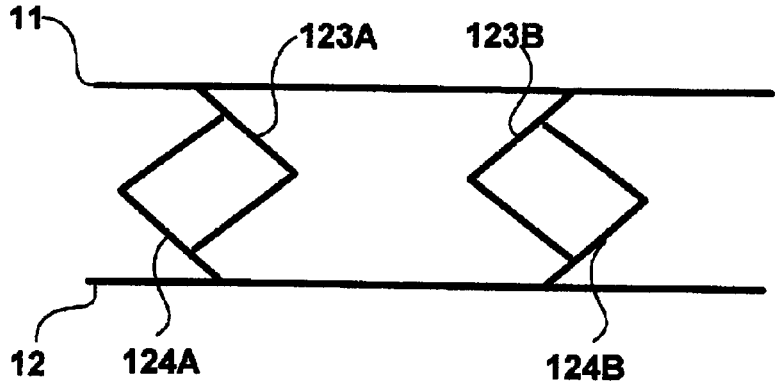
Figure 12C:
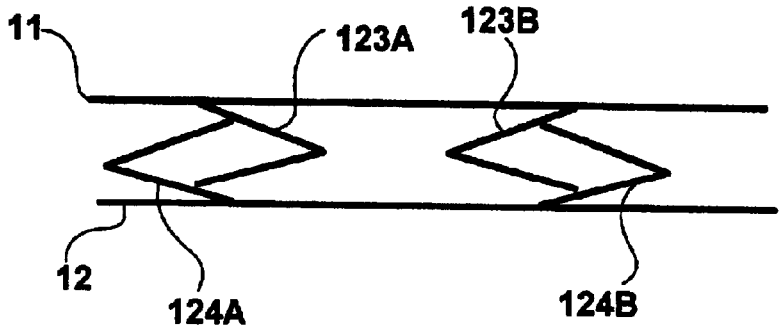

FIGS. 12A–12C are cross-sectional side views of another embodiment illustrating the flexing of fastening elements of an apparatus according to an embodiment of the invention. In this case, elements 123, 124 of layers 11, 12 comprise angle-shaped elements that flex upon themselves. For example, when the top and bottom layers 11, 12 are forced together, the angle-shaped elements 123, 124 flex upon themselves, providing a desired resistance and feel. Other shapes, including C-shaped fastening elements could also be implemented.

Figure 13:
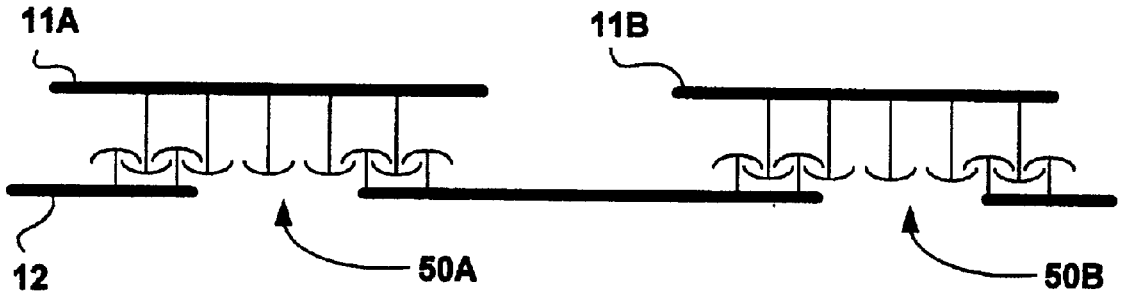
FIG. 13 is a cross-sectional side view of an apparatus according to the invention used to form two keys of a switch array.

FIG. 13 is a cross-sectional side view of an apparatus according to the invention used to form two keys of a switch array. In this case, top layer 11 of apparatus 10 includes a number of distinct top layer sections 11A and 11B. Each top layer section 11A, 11B is mechanically engaged with bottom layer 12 via sets of fastening elements. Bottom layer 12 may be formed with holes 50A, 50B. Each top layer section 11A, 11B may correspond to keys of the switch array.

When a key is pressed, a top layer section is forced toward bottom layer 12. For example, top layer section 11A may be forced against bottom layer 12 when that key is pressed. In that case, some elements of top layer 11A may extend through hole 50A to actuate a sensor element of the switch array. Other elements of top layer 11 contact the base of bottom layer 12 and are caused to flex and possibly buckle as outlined above. In this manner, a desired tactile feel can be achieved without implementing dome spring elements.

Figure 14:
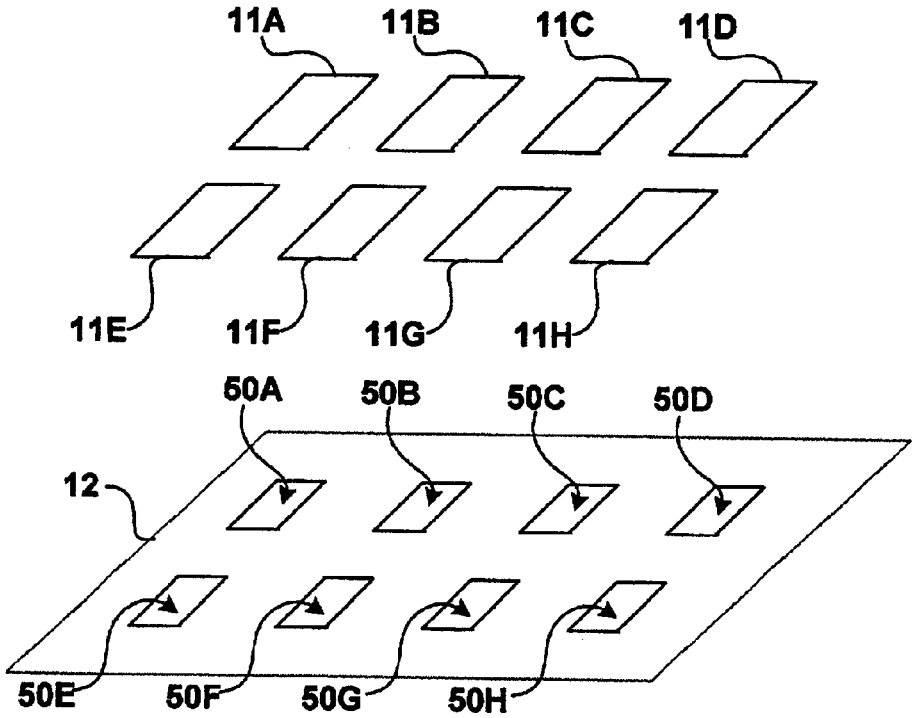
FIG. 14 is a perspective view of an unengaged apparatus according to the invention used to form a number of keys of a switch array.

FIG. 14 is a perspective view of an unengaged apparatus according to the invention used to form a number of keys of a switch array. As shown, apparatus 10 includes a bottom layer 12 and a top layer including a plurality of top layer sections 11A–11H. Bottom layer 12 can be engaged with each top layer section 11A–11H as described above. Bottom layer 12 is formed with holes 50A–50H for aligning with sensor elements of a switch array. For example, holes 50 may be sized in the range of 0.1 to 2.0 square centimeters although the invention is not necessarily limited in that respect. Holes 50 may take any shape envisioned by a designer. For example, the size and shape of holes 50 may be determined, in part, by the sensor elements to be actuated. Each top layer section 11A–11H may cover one of holes 50A–50H when the layers are engaged. For example, the top and bottom layers 11, 12 can be engaged simply by sliding or snapping the top layer sections 11A–11H onto the bottom layer 12.

Top layer sections 11A–11H may function as the keys that are depressed by a user. In this manner, thinner switch arrays and/or switch arrays having fewer elements can be realized. Alternatively, additional keycaps (not shown) may be attached to the respective top layer sections to be depressed by a user. Furthermore, for membrane switches, a membrane cover may cover apparatus 10.

In the embodiment illustrated in FIG. 14, it may be desirable to prevent lateral movement of top layer sections 11A–11H relative to bottom layer 12 when the layers are engaged. One way to limit lateral movement is to form regions (not shown) in bottom layer 12. A region may define an area for placement of a top layer section 11A–11H to limit the lateral motion of that top layer section 11A–11H relative to bottom layer 12 when the layers are engaged. For example, the fastening elements of bottom layer 12 may be heat sealed or crushed by a die in selected places to form the regions. Regions can be created in bottom layer 12 to define the area for placement of each top layer section 11A–11H. Some techniques for die crushing a fastening structure to form regions that can limit lateral motion of layers of an engaged fastening structure are described in commonly assigned international publication number WO 01/58302, which is incorporated herein by reference in its entirety.

If used in a switch array, top and bottom layers 11, 12 may provide a number of advantages in addition to the desired tactile feel outlined above. For example, engaged top and bottom layers 11, 12 can provide resistance to rocking of individual keys, and may ensure that individual keys are held in place and properly aligned with sensor elements. In this manner, top and bottom layers 11, 12 can function as alignment structures for individual keys of a switch array.

Additionally, the layers 11, 12 can be fabricated at relatively low cost by extrusion or injection molding. Moreover, assembly of switch arrays can be simplified significantly by replacing discrete alignment structures with top and bottom layers 11, 12. The top and bottom layers 11, 12 can be engaged simply by sliding or snapping them together such that fastening elements (for example having hook-like configurations) overlap one another to provide an interlocking arrangement. Machining of mounting brackets for alignment structures can be avoided. Also, the use of fastening structure 10 may enable the realization of thinner switch arrays by reducing the amount of key travel and reducing the number of layers in the switch array.

In addition, layers 11, 12 may provide additional design freedoms to the design of switch arrays. By implementing the fastening structure according to the invention, a switch array may not need a molding or frame to hold the keys in place. Moreover, the shape and layout of the keys can be improved both functionally and/or aesthetically. For example, adjacent keys may not need to be separated by molding. Removing the need for a molding or frame to hold keys in place can be particularly useful in switch arrays that form part of small devices such as cellular radio telephones, handheld computers and other devices where surface area and depth is very limited. Because molding can be eliminated, more space may be dedicated to the keys themselves.

EXAMPLE

An elastomeric structure 10 having the self-mating profile illustrated in FIGS. 1A and 1B was created by coextrusion of a film having a base portion of elements 11 and 12 that is substantially rigid and stem and hook portions of elements 11 and 12 that are substantially flexible. Specifically, a melt-processable ethylene-propylene copolymer (7C55H or 7C06 supplied by Union Carbide Corporation, now Dow Chemical Corp. of Midland, Mich.) used for the base sheet was fed into a single-screw extruder (supplied by Davis Standard Corporation of Pawcatuck Conn.) having a diameter of approximately 6.35 centimeters (2.5 inches), a length/diameter ratio of 24/1, and a temperature profile that steadily increased from approximately 175–232 degrees Celsius (350–450 degrees Fahrenheit). Likewise, a thermoplastic elastomer polymer (Engage 8100 supplied by Dupont-Dow Elastomers L. L. C., Wilmington, Del.) used for the stem and hook was fed into a second single screw extruder (also supplied by Davis Standard Corporation) having a diameter of 3.81 centimeters (1.5 inches), a length/diameter (L/D) ratio of 24/1, and an identical temperature profile. The polypropylene copolymer and thermoplastic elastomer resins were each continuously discharged at pressures of at least 690,000 Pascals (100 pounds per square inch) through necktubes heated to 232 degrees Celsius (450 degrees Fahrenheit) and into one port of a 3-layer adjustable vane feedblock (supplied by Cloeren Company, Orange, Tex.) configured to form a 2-layer film construction. The feedblock was mounted atop a 20-centimeter wide (8-inch wide) MasterFlex™ LD-40 film die (supplied by Production Components, Eau Claire, Wis.), both of which were maintained at a temperature of 232 degrees Celsius (450 degrees Fahrenheit). The 2-layer resin stack created in the feedblock was fed into the die which had a die lip configured to form a polymeric hook film having the self-mating profile shown in FIGS. 1A and 1B.

The 2-layer film was extruded from the die and drop-cast at about 3 meters/minute (10 feet/minute) into a quench tank maintained at 10–21 degrees Celsius (50–70 degrees Fahrenheit) for a residence time of at least 10 seconds. The quench medium was water with 0.1–1.0% by weight of a surfactant, Ethoxy CO-40 (a polyoxyethylene caster oil available from Ethox Chemicals, LLC of Greenville, S.C.), used to increase wet-out of the hydrophobic polyolefin materials.

The quenched film was then air-dried and collected in 91–137 meter rolls (100–150 yard rolls). The film had a uniform base film caliper of approximately 0.0356±0.005 centimeters (0.014±0.002 inches), a hook element width (the distance between the outermost ends of the hook element arms, measured in a plane parallel to the base of the film) of about 0.1524±0.005 centimeters (0.060±0.002 inches). The film had an extruded basis weight of approximately 700 grams/square meter. The vertical travel permitted was approximately 0.094 centimeters (0.037 inches). In a separate operation, the extruded films were annealed to flatten the base sheet by passage over a smooth cast roll maintained at approximately 93 degrees Celsius (200 degrees Fahrenheit), and then wound onto 15.24 centimeter cores (6 inch cores) to minimize web-curl.

To form layers 11 and 12 as described herein, a substantially rigid material and a substantially flexible material can be co-extruded in a manner similar to the example described above. The co-extrusion process can also be used to create structure 10 in which the stem portions of the elements of layers 11 and 12 are flexible, while the base and hook-element portions of layers 11 and 12 are substantially rigid. The temperatures and specifications of the co-extrusion process may need to be adjusted slightly depending on the materials used. In addition, these materials can also be extruded as single layers, where, for example, layer 11 is made from a substantially rigid material and layer 12 is made from a substantially elastic material. Alternatively, the extruded and co-extruded structures may have any mated profile, such as one of the profiles illustrated and described above.

Flexible materials that may be used in the co-extrusion process may include natural or synthetic rubbers and block copolymers that are elastomeric, such as those knows as A-B or A-B-A copolymers. Useful elastomeric compositions include, for example, styrene/isoprene/styrene (SIS) block copolymers, elastomeric polyurethanes, ethylene copolymers such as ethylene vinyl acetates, ethylene/propylene monomer copolymer elastomers or ethylene/propylene/diene terpolymer elastomers. Blends of these elastomers with each other or with modifying non-elastomers may also be used. For example, up to 50 percent by weight and less than 30 percent by weight of polymers can be added as stiffing aids such as polyvinylstyrenes, e.g., polyalphamethyl styrene, polyesters, epoxies, polyolefins (polyethylene or certain ethylene/vinyl acetates such as those having a high molecular weight), or coumarone-indene resin.

Suitable rigid materials may include polymeric materials, using generally any polymer that can be melt processed. Homopolymers, copolymers and blends of polymers are useful, and may contain a variety of additives. Inorganic materials such as metals may also be used. Suitable thermoplastic polymers include, for example, polyolefins such as polypropylene or polyethylene, polystyrene, polycarbonate, polymethyl methacrylate, ethylene vinyl acetate copolymers, acrylate-modified ethylene vinyl acetate polymers, ethylene acrylic acid copolymers, nylon, polyvinylchloride, and engineering polymers such as polyketones or polymethylpentanes. Mixtures of polymers and elastomers may also be used.

Suitable additives include, for example, plasticizers, tackifiers, fillers, colorants, ultraviolet light stabilizers, antioxidants, processing aids (urethanes, silicones, fluoropolymers, etc.), low-coefficient-of friction materials (silicones), conductive fillers, pigments and combinations thereof. Generally, additives can be present in amounts up to 50 percent by weight of the composition depending on the application.

Figure 15:
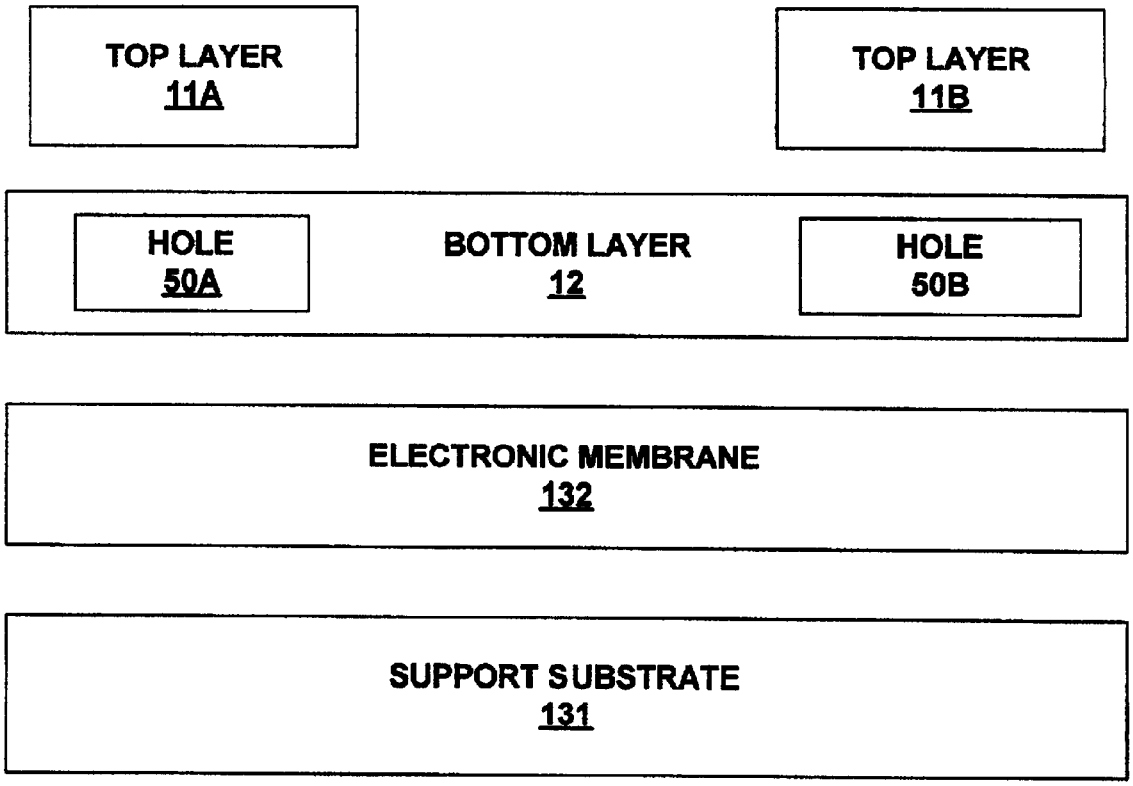
FIG. 15 is an exploded block diagram of two switches of a membrane switch according to an embodiment of the invention.

FIG. 15 is an exploded block diagram of two switches of a switch array according to an embodiment of the invention.

As shown, a switch array may include a support substrate 131 to provide mechanical stability. An electronic membrane 133 may reside on top of the support substrate 131. The electronic membrane may include a plurality of sensors that generate signals in response to an applied physical force. An apparatus as outlined above may be positioned on top of the electronic membrane 132 to facilitate switch actuation and provide a desirable tactile feel.

For example, bottom layer 12 can be formed with holes 50A–50B for aligning with sensor elements of electronic membrane 132. A top layer 11 defines top layer sections 11A and 11B that correspond to the holes 50A and 50B in bottom layer 12. In other words, each top layer section 11A and 11B may cover one of the holes 50A and 50B when the top and bottom layers 11, 12 are engaged. When a physical force is applied to one of the top layer sections 11A or 11B, the force can cause flexing of one or more elements of the top or bottom layers to provide a desirable tactile feel. When a top layer section 11A, 11B is pressed upon bottom layer 50, actuation of a sensor element of electronic membrane 132 can be achieved. An optional membrane cover (not shown) may cover the top and bottom layers 11, 12, or alternatively, additional keycaps can be added.

The fastening structure including a top layer engaged with a bottom layer as described above may provide design freedoms to a switch array designer. Indeed, compared to conventional switch array configurations, the alignment elements described herein may allow a larger number of keys to be realized in the same amount of area, and can allow the keys to be placed more closely together by eliminating the molding that covers the keys.

Furthermore, the elimination of dome spring elements can facilitate switch arrays with fewer elements, and can possibly lower cost associated with switch arrays. In addition, as described above, the thickness of switch arrays may be reduced by implementing the fastening structure. Moreover, the need for additional keycaps can be eliminated, although keycaps may also be added. The fastening structure may also provide alignment advantages including facilitating a larger useful contact area for the key, e.g., a larger "sweet spot," and providing resistance to key rocking.

Additionally, the fastening structure can form chambers to enhance audible indication of key actuation. In other words, the fastening structure as described herein can improve or enhance audible sounds caused by the actuation of keys. Thus, actuation of the key may be accompanied by a tactile feel and a more noticeable audible indication. In addition, the fastening structure as described herein may provide a hermetic barrier or a partial hermetic barrier between the environment and sensors of a switch array. In these or other ways, the fastening structure may be used to improve switch arrays. Exemplary implementations of the invention within switch arrays may include implementations within membrane switches, keypads or keyboards. For example, the invention may be implemented to form part of handled computer devices such as palm computers or cellular radio telephones, laptop or desktop keyboards, switch arrays on an instrument panel of an aircraft, watercraft or motor vehicle, switch arrays in appliances, musical instruments or the like, or any other application where switches are used. In addition, although embodiments have been described for creating a fastening structure via a co-extrusion process, other processes may be used to realize the same or similar structures. For example, extrusion, profile-extrusion, injection molding, compression molding, thermoforming, rapid prototyping, cast and cure, embossing, or other processes may also be used to realize one or more of the structures described herein. Accordingly, other implementations and embodiments are within the scope of the following claims.

What is claimed is:

1. An apparatus for use in a switch array comprising:

a first layer including a first set of fastening elements; and a second layer including a second set of fastening elements, wherein the first and second sets of fastening elements are engageable to thereby attach the first layer to the second layer, and wherein at least some of the fastening elements include a flexible portion that flexes when the first and second layer are engaged and the first layer is forced toward the second layer.

2. The apparatus of claim 1, wherein flexing of the flexible portion of at least some of the fastening elements provides a biasing force between the first and second layers.

3. The apparatus of claim 2, wherein the biasing force provided by the flexing is different depending on a distance between the first and second layers.

4. The apparatus of claim 3, wherein the biasing force substantially decreases when the distance between the first and second layers passes a threshold.

5. The apparatus of claim 1, wherein the engaged sets of fastening elements comprise hook-like elements that collectively define a distance of travel between the first and second layers, wherein at least some of the hook-like elements include stem portions that form the flexible portions.

6. The apparatus of claim 1, wherein the engaged sets of fastening elements comprise Y-shaped elements that collectively define a distance of travel between the first and second layers, wherein tips of the Y-shaped elements form at least part of the flexible portions.

7. The apparatus of claim 1, wherein the engaged sets of fastening elements comprise angle-shaped elements.

8. The apparatus of claim 1, wherein the engaged sets of fastening elements comprise C-shaped elements.

9. The apparatus of claim 1, wherein the flexible portions of at least some of the fastening elements comprise extensions that extend from at least some of the fastening elements.

10. The apparatus of claim 9, wherein the extensions are C-shaped extensions.

11. An apparatus for use in a switch array comprising:

a bottom layer;

a top layer; and means for engaging the top and bottom layers such that upon engagement, an amount of travel is defined between the top and bottom layers, wherein the means for engaging includes a means for flexing when the top layer is forced toward the bottom layer.

12. The apparatus of claim 11, wherein the means for flexing provides a biasing force between the top and bottom layers.

13. The apparatus of claim 12, wherein the biasing force provided by the means for flexing is different depending on a distance between the top and bottom layers.

14. The apparatus of claim 13, wherein the biasing force substantially decreases when the distance between the top and bottom layers passes a threshold.

15. The apparatus of claim 11, wherein the means for engaging includes a plurality of hook-like elements that collectively define a distance of travel between the top and bottom layers.

16. The apparatus of claim 11, wherein the means for engaging comprise Y-shaped elements that collectively define a distance of travel between the top and bottom layers.

17. The apparatus of claim 11, wherein the means for engaging comprise angle-shaped elements.

18. The apparatus of claim 11, wherein the means for engaging include C-shaped elements.

19. The apparatus of claim 11, wherein the means for flexing comprise extensions that extend from at least some of the fastening elements.

20. The apparatus of claim 19, wherein the extensions are C-shaped extensions.

21. A switch array comprising:

an array of sensor elements that generate signals upon actuation;

a bottom layer including a first set of fastening elements, the bottom layer defining holes for aligning with the array of sensor elements; and a number of top layer sections each including second sets of fastening elements, wherein the first and second sets of fastening elements are engaged, thereby attaching the bottom layer to the top layer sections, and wherein at least some of the fastening elements include a flexible portion that flexes when one of the top layer sections are forced toward the bottom layer, and wherein forcing one of the top layer sections toward the bottom layer causes actuation of one of the sensor elements.

22. The switch array of claim 21, wherein the engaged sets of fastening elements define a distance of travel between the bottom layer and each top layer section.

23. The switch array of claim 21, wherein each of the top layer sections comprises a key of the switch array.

24. The switch array of claim 21, the top layer sections and the bottom layer are extruded films.

25. The switch array of claim 21, wherein the switch array is selected from the following group of switch arrays: a computer keyboard, a membrane switch array, a keypad, an instrument panel of an aircraft, an instrument panel of a watercraft, an instrument panel of a motor vehicle, a switch array for an appliance and a switch array of a musical instrument.

26. A switch array that does not include any dome spring elements, the switch array comprising:

a set of keys, and a set of sensor elements, wherein the set of keys are biased away from the set of sensor elements, wherein a biasing force for a key in the set substantially decreases when the key is pressed passed a threshold.

27. The switch array of claim 26, wherein the set of keys comprise a number of top layer sections engaged with a bottom layer via fastening elements, wherein at least some of the fastening elements include a flexible portion that flexes when the key is pressed.

28. The switch array of claim 27, wherein the flexible portions of the fastening elements buckle when a key is pressed.

29. A switch array apparatus comprising:

a first layer defining one or more keys;

a second layer; and a number of fastening elements formed on the first and second layers that fasten the layers, wherein at least some of the fastening elements include a flexible portion that flexes when a key of the first layer is pressed toward the second layer.

* * * * *

UNITED STATES PATENT AND TRADEMARK OFFICE

CERTIFICATE OF CORRECTION

PATENT NO. : 6,740,832 B2
DATED : May 25, 2004
INVENTOR(S) : Johnston, Raymond P.

It is certified that error appears in the above-identified patent and that said Letters Patent is hereby corrected as shown below:

Title page,
Item [56], References Cited, U.S. PATENT DOCUMENTS , delete "Szablowdkil" and insert in place thereof -- Szablowskil --.

Signed and Sealed this

Tenth Day of May, 2005

JON W. DUDAS
*Director of the United States Patent and Trademark Office*